US012564274B1

(12) United States Patent
Flannery et al.

(10) Patent No.: US 12,564,274 B1
(45) **Date of Patent: *Mar. 3, 2026**

(54) SCISSORING BASSINET WITH SOFT INSIDE AND OUTSIDE

(71) Applicant: Regalo International, LLC, Burnsville, MN (US)

(72) Inventors: Mark A. Flannery, Longboat Key, FL (US); Matthew A. Willms, Woodbury, MN (US); William D. Butterfield, River Falls, WI (US)

(73) Assignee: Regalo International, LLC, Burnsville, MN (US)

( * ) Notice: Subject to any disclaimer, the term of this patent is extended or adjusted under 35 U.S.C. 154(b) by 946 days.

This patent is subject to a terminal disclaimer.

(21) Appl. No.: 17/685,337

(22) Filed: Mar. 2, 2022

Related U.S. Application Data

(63) Continuation of application No. 16/592,670, filed on Oct. 3, 2019, now Pat. No. 11,266,253.

(51) Int. Cl.
*A47D 9/00* (2006.01)
*A47D 15/00* (2006.01)

(52) U.S. Cl.
CPC ..... *A47D 9/005* (2013.01); *A47D 15/00* (2013.01)

(58) Field of Classification Search
CPC ..... A47D 9/005; A47D 7/002; A47D 11/007; A47D 13/06; A47D 13/061; A47D 13/063; A47D 15/00
USPC ..... 5/98.2, 99.1
See application file for complete search history.

(56) References Cited

U.S. PATENT DOCUMENTS

| | | | | |
|---|---|---|---|---|
| 1,950,603 | A | 3/1934 | Fischer | |
| 2,698,443 | A | 1/1955 | Ralick | |
| 2,974,325 | A | 3/1961 | Roberto | |
| 4,186,454 | A | 2/1980 | Cone | |
| 4,202,065 | A | 5/1980 | Sullivan | |
| 4,573,224 | A | 3/1986 | Saint | |
| 5,826,285 | A * | 10/1998 | Mariol | A47D 13/063 5/99.1 |
| 5,947,552 | A | 9/1999 | Wilkins | |
| 7,401,367 | B2 * | 7/2008 | Gehr | A47D 13/063 5/98.1 |
| 8,024,825 | B2 * | 9/2011 | Harrison | A61G 5/0891 5/99.1 |
| 9,144,325 | B1 * | 9/2015 | Sousa | A47D 7/002 |
| 10,194,755 | B1 * | 2/2019 | Flannery | A47D 13/063 |
| 10,448,752 | B1 | 10/2019 | Flannery | |
| 10,557,282 | B1 | 2/2020 | Flannery | |

(Continued)

FOREIGN PATENT DOCUMENTS

WO 2015175079 A1 11/2015

*Primary Examiner* — David R Hare

(57) ABSTRACT

A bassinet with a scissoring frame having upper, lower, and intermediate junctions. The bassinet includes sheeting that is one-piece, that has open and closed ends, and that forms a floor and inside and outside walls. The closed end forms the floor of a flexible wall and floor combination. The sheeting extends in an endless manner from the floor up the inside of the frame to the top of the frame, further extends in an endless manner over the top of the frame to the outside of the frame, and still further extends in an endless manner down the outside of the frame to locations adjacent to the intermediate junctions where the open end of the sheeting is engaged to the frame.

18 Claims, 7 Drawing Sheets

(56) References Cited

U.S. PATENT DOCUMENTS

| | | | | |
|---|---|---|---|---|
| 11,266,253 | B1 * | 3/2022 | Flannery | A47D 9/00 |
| 2003/0098053 | A1 * | 5/2003 | Huang | A47C 29/003 135/96 |
| 2005/0045221 | A1 | 3/2005 | Forshpan | |
| 2005/0150046 | A1 | 7/2005 | Gehr | |
| 2005/0166316 | A1 * | 8/2005 | Gehr | A47D 13/063 5/99.1 |
| 2008/0034498 | A1 | 2/2008 | Chen | |
| 2012/0192355 | A1 * | 8/2012 | Manzanares | A47D 5/006 5/655 |
| 2016/0227939 | A1 | 8/2016 | Tadipatri | |
| 2018/0035814 | A1 | 2/2018 | Peleg | |

* cited by examiner

SCISSORING BASSINET WITH SOFT INSIDE AND OUTSIDE

This application is a continuation of U.S. patent application Ser. No. 16/592,670 filed Oct. 3, 2019 (U.S. Pat. No. 11,266,253 issued Mar. 8, 2022) and claims the benefit thereof under 35 U.S.C. § 120, which application is hereby incorporated by reference in its entirety into this application.

FIELD OF THE INVENTION

The present invention relates to a bassinet, particularly to a collapsible bassinet, and specifically to a collapsible bassinet having a frame as a hard unit, and a flexible floor, flexible inside wall, and flexible outside wall as a soft integral unit that is removably engaged to the frame.

BACKGROUND OF THE INVENTION

The origin of the word "bassinet" may be a modification of the French word "barcelonnett" that is diminutive of the French word "berceau" that means cradle. "Diminutive" means to grammatically indicate a small size, like "kitchenette" relates to "kitchen."

Classical definitions of "bassinet" include 1) a baby's basketlike bed often with a hood over one end, 2) a small bed for a baby that looks like a basket and that usually has a hood or cover over one end, and 3) a basket with a hood over one end, for use as a baby's cradle.

SUMMARY OF THE INVENTION

A feature of the present invention is a bassinet.

Another feature of the present invention is the provision in a bassinet, of a frame being a hard unit.

Another feature of the present invention is the provision in a bassinet, of a soft unit being a flexible floor, flexible inner wall, and flexible outer wall integral combination.

Another feature of the present invention is the provision in a bassinet, of a collapsible frame.

Another feature of the present invention is the provision in a bassinet, of a scissoring frame.

Another feature of the present invention is the provision in a bassinet, of a frame, where the frame is endless, where the frame includes upper junctions, intermediate junctions, and lower junctions, where the frame is a scissoring frame, and where the frame includes an outside, an inside, a top, and a bottom.

Another feature of the present invention is the provision in a bassinet, of a flexible sheet having a first sheet end, a second sheet end, and an intermediate sheet portion, where the first sheet end is open and the second sheet end is closed and is a floor, where the flexible sheet extends inside of the frame from the bottom of the frame to the top of the frame, where the flexible sheet extends over the top of the frame, and where the flexible sheet extends outside of the frame from the top of the frame to intermediate frame locations adjacent to the intermediate junctions.

Another feature of the present invention is the provision in a bassinet, of the first sheet end having a first endless edge portion, and of the second sheet end having a second endless edge portion.

Another feature of the present invention is the provision in a bassinet, of the first endless edge portion of the first sheet end being engaged to the frame adjacent to the intermediate junctions.

Another feature of the present invention is the provision in a bassinet, of the second endless edge portion of the second sheet end being engaged to the frame adjacent to the lower junctions.

Another feature of the present invention is the provision in a bassinet, of the intermediate sheet portion including a third endless edge portion, and wherein the third endless edge portion is engaged to the frame adjacent to the upper junctions.

Another feature of the present invention is the provision in a bassinet, of the sheeting being one-piece.

Another feature of the present invention is the provision in a bassinet, of the first endless edge portion of the first sheet end being engaged adjacent to the intermediate junctions on the outside of the frame.

Another feature of the present invention is the provision in a bassinet, of the second endless edge portion of the second sheet end being engaged adjacent to the lower junctions on the outside of the frame.

Another feature of the present invention is the provision in a bassinet, of the third endless edge portion of the intermediate sheet portion being engaged adjacent to the upper junctions on the outside of the frame.

Another feature of the present invention is the provision in a bassinet, of an endless frame where the endless frame includes an outside, an inside, a top, and a bottom, and of sheeting where the sheeting includes an outer endless sheet wall, an inner endless sheet wall, and a closed end, where the outer endless sheet wall is disposed outside of the frame, where the inner endless sheet wall is disposed inside of the frame, and where the outer and inner endless sheet walls are integrally joined adjacent to a top of the frame.

Another feature of the present invention is the provision in a bassinet, of the outer endless sheet wall having a distal end endless edge portion spaced from the top of the frame and spaced from the bottom of the frame where the distal end endless edge portion is engaged to the frame.

Another feature of the present invention is the provision in a bassinet, of the outer endless sheet wall having an upper endless edge portion adjacent to the top of the frame where the upper endless edge portion is engaged to the frame.

Another feature of the present invention is the provision in a bassinet, of the inner endless sheet wall being engaged to the closed end where the closed end includes a bottom endless edge portion adjacent to the bottom of the frame, and where the bottom endless edge portion is engaged to the bottom of the frame.

Another feature of the present invention is the provision in a bassinet, of the distal end endless edge portion of the sheeting being engaged to the frame at a plurality of intermediate frame locations where the intermediate frame locations define an intermediate plane.

Another feature of the present invention is the provision in a bassinet, of the upper endless edge portion of the sheeting being engaged to the frame at a plurality of upper frame locations where the upper frame locations define an upper plane.

Another feature of the present invention is the provision in a bassinet, of the bottom endless edge portion of the sheeting being engaged to the frame at a plurality of lower frame locations where the lower frame locations define a bottom plane.

Another feature of the present invention is the provision in a bassinet, of the upper plane being spaced from the intermediate plane which in turn is spaced from the bottom plane.

Another feature of the present invention is the provision in a bassinet, of each of the upper frame locations defining a vertical line with one of the lower frame locations and of each of the intermediate frame locations being staggered relative to the upper and lower frame locations such that each of the intermediate frame locations is disposed between two adjacent vertical lines.

Another feature of the present invention is the provision in a bassinet, of each of the intermediate frame locations being on the outside of the frame.

Another feature of the present invention is the provision in a bassinet, of each of the upper frame locations being on the outside of the frame.

Another feature of the present invention is the provision in a bassinet, of each of the lower frame locations being on the outside of the frame.

Another feature of the present invention is the provision in a bassinet, of each of the upper and lower frame locations being on the outside of the frame.

Another feature of the present invention is the provision in a bassinet, of each of the upper, intermediate, and lower frame locations being on the outside of the frame.

Another feature of the present invention is the provision in a bassinet, of each of the intermediate junctions having an intermediate quick connect where the intermediate quick connect is disposed on an outer portion of the intermediate junction.

Another feature of the present invention is the provision in a bassinet, of each of the lower junctions having a lower quick connect where the lower quick connect is disposed on an outer portion of the lower junction.

Another feature of the present invention is the provision in a bassinet, of a flexible sheet having a first sheet end and a second sheet end, where the first sheet end is open, where the second sheet end is closed and is a floor, where the first sheet end includes a first endless edge portion, and where the second sheet end includes a second endless edge portion.

Another feature of the present invention is the provision in a bassinet, of the first endless edge portion having quick connects that engage to each of the intermediate quick connects.

Another feature of the present invention is the provision in a bassinet, of the flexible sheet having an outer sheet endless wall portion that extends from the intermediate junctions to the top portion of the frame, where the outer sheet endless wall portion is outside the frame.

Another feature of the present invention is the provision in a bassinet, of the flexible sheet having an inner sheet endless wall portion that extends from the top portion of the frame to the bottom portion of the frame where the inner sheet endless wall portion engages the second end of the sheeting, and where the inner sheet endless wall portion is inside the frame.

Another feature of the present invention is the provision in a bassinet, of the second endless edge portion of the second end of the sheeting having quick connects that engage each of the lower quick connects.

Another feature of the present invention is the provision in a bassinet, of the sheeting extending from the intermediate junctions to the top of the frame along the outside of the frame, from a top outside of the frame to a top inside of the frame, from the top inside of the frame to the bottom of the frame along an inside of the frame, and from a bottom inside of the frame to a bottom outside of the frame where the sheeting engages the lower quick connects.

Another feature of the present invention is the provision in a bassinet, of each of the upper junctions including an upper quick connect, where the upper quick connect is disposed on an outer portion of the upper junction, and where the sheeting includes quick connects that engage each of the upper quick connects.

Another feature of the present invention is the provision in a bassinet, of each of the lower junctions including a bottommost face, where the second endless edge portion of the second end of the sheeting extends from inside of the frame to outside of the frame at the lower junction, and where the bottommost face of the lower junction is disposed on top of the second endless edge portion of the second end of the sheeting.

Another feature of the present invention is the provision in a bassinet, of a panel engaged to a flexible wall and floor combination, where the panel includes sheeting having a perimeter, where the perimeter includes a flexible elongate stiffener, where the flexible elongate stiffener is biased to an open nontensioned form where the panel defines a plane, and where the panel includes a U-shaped form where the flexible elongate stiffener is under tension.

Another feature of the present invention is the provision in a bassinet, of the panel having first and second ends, where each of the first and second ends are engagable to one of the frame and flexible wall and floor combination such that, when each of the first and second ends are engaged to one of the frame and flexible wall and floor combination, the panel has a U-shaped form.

Another feature of the present invention is the provision in a bassinet, of the panel including a first face and a second face, where the first and second faces face in opposite directions in the open form, where the panel is twistable from the open nontensioned form where the panel defines a plane to a twisted form where a portion of the first face confronts a portion of the second face.

Another feature of the present invention is the provision in a bassinet, of an engagement between the first end and one of the frame and flexible wall and floor combination being a flexible engagement, and where an engagement between the second end and one of the frame and flexible wall and floor combination is a flexible engagement such that the panel in the U-shaped form can be moved vertically and horizontally.

Another feature of the present invention is the provision in a bassinet, of the first end of the panel being removably engaged to the flexible wall and floor combination, and of the second end of the panel being removably engaged to the flexible wall and floor combination.

Another feature of the present invention is the provision in a bassinet, of the first end of the panel being removably engaged to the flexible wall and floor combination at a first location on an inside of the flexible wall and floor combination, and of the second end of the panel being removably engaged to the flexible wall and floor combination at a second location on the inside of the flexible wall and floor combination, where the first and second locations are diametrically opposite of each other.

Another feature of the present invention is the provision in a bassinet, of the first location, where the first end of the panel is engaged to the inside of the flexible wall and floor combination, being spaced from each of the open end and closed end of the flexible wall and floor combination, and of the second location, where the second end of the panel is engaged to the inside of the flexible wall and floor combination, being spaced from each of the open end and closed end of the flexible wall and floor combination.

An advantage of the present invention is a bassinet that is relatively small. Since the bassinet is relatively small, it is relatively lightweight, more compact, and takes up less space when deployed in an opened up form or in a folded form.

Another advantage of the present invention is a flexible wall and floor combination that is relatively small. Since the flexible wall and floor combination is relatively small, it can be engaged relatively easily and quickly to its companion small frame and, likewise, it can be disengaged easily and quickly from such small frame.

Another advantage of the present invention is that the frame is relatively small. Since the frame is relatively small, it is easily and quickly scissored open by one person and easily and quickly scissored closed by one person.

Another advantage of the present invention is that it is safe. One feature contributing to this advantage is that a relatively great portion of the scissoring frame is enclosed by the sheeting of the flexible wall and floor combination. The sheeting of the flexible wall and floor combination includes inner and outer integral sheeting portions that enclose therebetween the upper half of the scissoring frame.

Another advantage of the present invention is its aesthetics. One feature contributing to this advantage is the outer integral sheeting portion that extends from the upper junctions to the intermediate junctions, thereby covering the upper half of the scissoring frame.

Another advantage of the present invention is that an unintended folding of an open bassinet is minimized by a mechanical over center lock having exclusively hard components and by a mechanical lock having a combination of hard and soft components, where the hard components include quick connect snaps and where the soft components include a floor sheeting portion between lower junctions to keep support member pairs from scissoring in the direction where the lower junctions spread apart from one another so as to decrease the height of the frame, a sheeting portion between upper junctions to keep support member pairs from scissoring in the direction where upper junctions spread apart from one another so as to decrease the height of the frame, an inside wall sheeting portion between the lower and upper junctions to keep support member pairs from scissoring in the direction where the lower junctions are drawn toward one another and where the upper junctions are drawn toward one another so as to increase the height of the frame, and an outside wall sheeting portion that maximizes the chances that the upper junction quick connections remain engaged.

Another advantage of the present invention is that each of the frame and flexible wall and floor combination is simple and inexpensive to manufacture.

DESCRIPTION

Figure 5A:
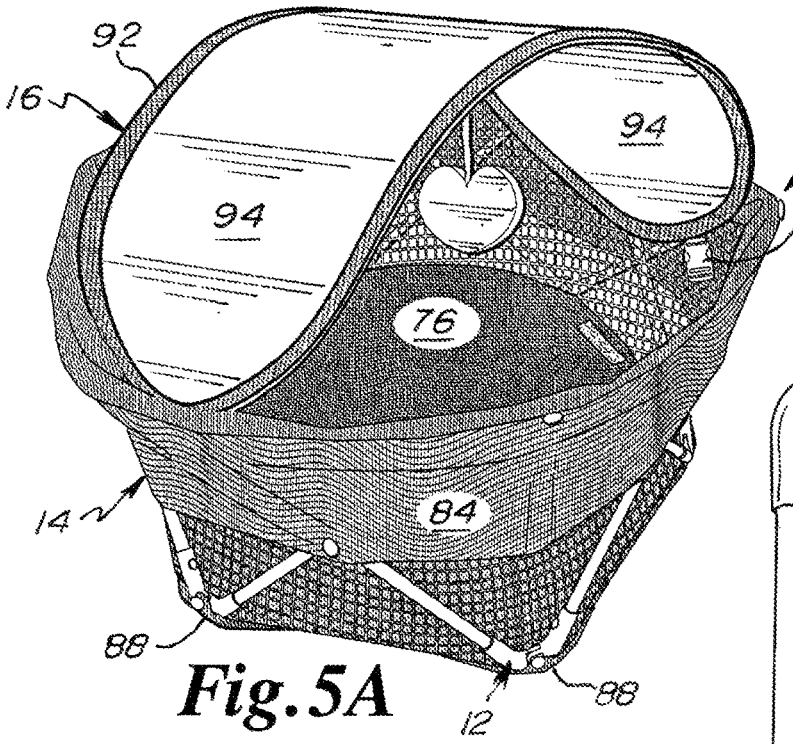
FIG. 5A is a top perspective view of the present bassinet of FIG. 4 having a canopy engaged over the open top of the bassinet, which canopy is shown in FIG. 6C.

As shown in FIG. 5A, the present bassinet is indicated in general by the reference number 10. Bassinet 10 includes a frame 12, sheeting 14, and a canopy 16.

Figure 1:
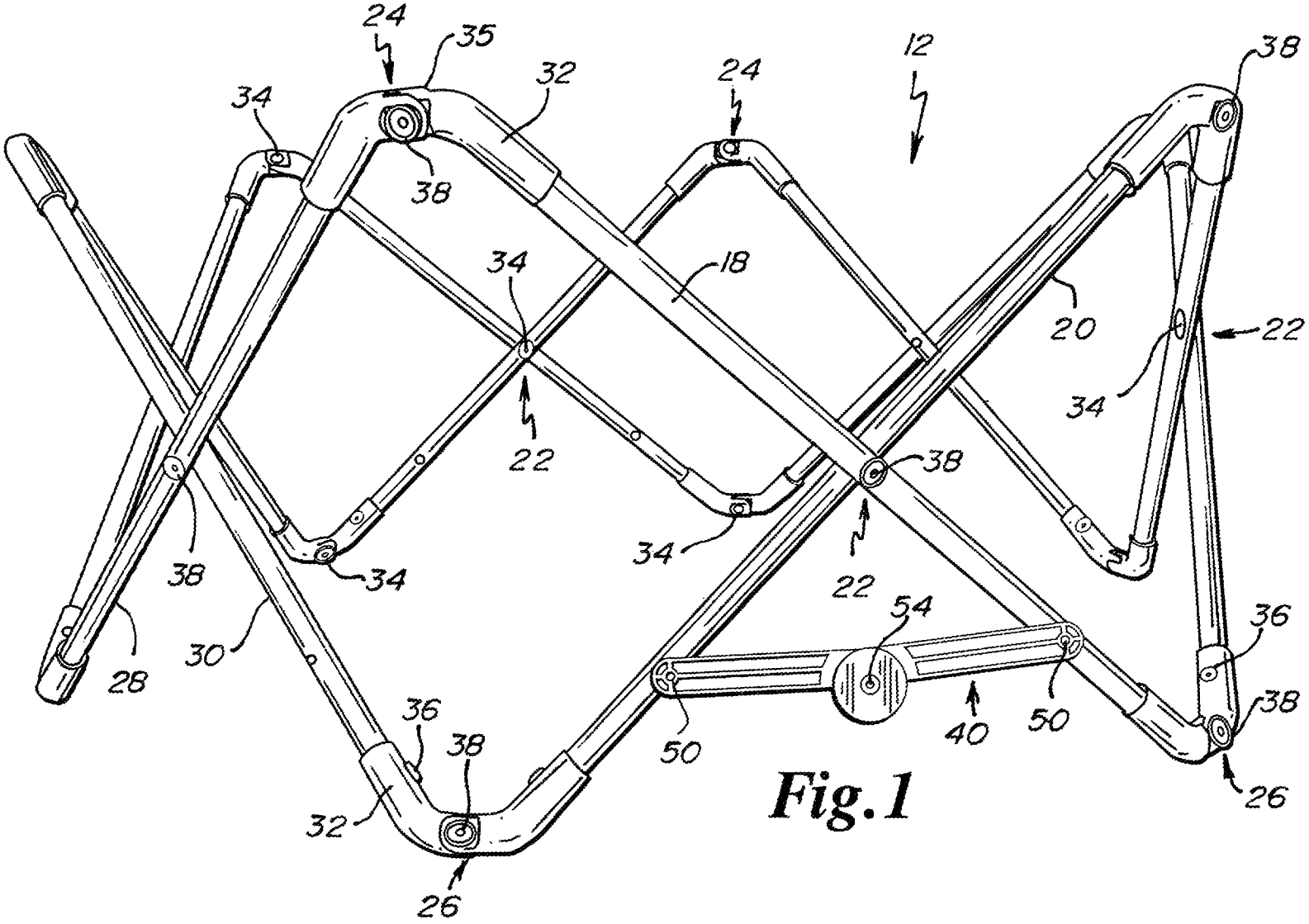
FIG. 1 is a side perspective view of the frame or hard components of the present bassinet.

Frame 12 is shown in FIG. 1. Frame 12 is a scissoring frame. Frame 12 folds out to an operating position, as shown in FIG. 1. Frame 12 folds in to a compact position, as shown in FIG. 5D. Frame 12 includes pairs of tubular metal support members 18, 20. Each of the pairs of support members 18, 20 forms an X shape. Support members 18, 20 are pivotally engaged by an intermediate junction 22. One support member pair is pivotally engaged to an adjacent support member pair by an upper junction 24 and by a lower junction 26. In the present bassinet, there are six pairs of support members 18, 20.

There is an outer train 28 of alternating support members 18, 20. There is an inner train 30 of alternating support member 18, 20. The outer train 28 is engaged to the inner train 30 by the intermediate junctions 22. The outer train 28 does not share upper junctions 24 or lower junctions 26 with the inner train 30. Each of the trains 28, 30 have their own upper and lower junctions 24, 26. Each of the trains 28, 30 have alternate support members 18, 20. Each of the trains 28, 30 has a support member 18, 20 obliquely increasing in height and an adjacent support member 18, 20 obliquely decreasing in height.

Each of the upper and lower junctions 24, 26 has a pair of tubular female receptors 32. The tubular receptors 32 are pivotally engaged by a junction pin 34. Each of the upper and lower junctions 24, 26 have junction pin 34. The intermediate junction 22 also includes a junction pin 34.

The tubular receptors 32 have fingers 35 that mesh with each other. Pin 34 extends through such fingers 35. One tubular receptor 32 receives an end of support member 18. The other tubular receptor 32 receives an end of support member 20. A transverse pin 36 extends from the tubular receptor 32 into the support member end to fix the support member 18, 20 in its respective tubular receptor 32.

Each of the support members 18, 20 is oblique when the frame is in the open and operating form. Relative to a horizontal surface, the axis of each of the support members 18, 20 is oblique. Relative to a vertical surface that is disposed at a right angle relative to the horizontal surface, each of the axes of the support members 18, 20 is oblique. Oblique means: neither parallel nor at a right angle to a specified or implied line; slanting.

Each of the intermediate, upper, and lower junctions 22, 24, 26 includes a snap portion 38. Snap portion 38 may be referred to as a quick connect. Snap portion 38 is engaged to its junction by junction pin 34. Each of the snap portions 38 is on an outside portion of its respective junction and thus is on an outside portion of frame 12. Junction pin 34 extend from an inside portion of the frame 12 to the snap portion 38. Junction pin 34 is one-piece with snap portion 38. Snap portions 38 on the upper junctions 24 are vertically aligned with their respective snap portions 38 on the lower junctions 26. Snap portions 38 on the intermediate junctions 22 are staggered relative to the snap portions 38 on the upper and lower junctions 24, 26. The snap portions 38 on the upper and lower junctions 24, 26 define vertical lines set at a right angle to the horizontal when frame 12 is set up in the open and operating form on a horizontal surface, and snap portions 38 on the intermediate junctions 22 are disposed between two such adjacent vertical lines.

Junction pin 34 of upper junction 24 has an axis that extends obliquely: namely, outwardly and downwardly. Junction pin 34 of lower junction 26 has an axis that extends obliquely: namely, outwardly and upwardly. Junction pin 34 of intermediate junction 22 has an axis that extends outwardly and horizontally.

Each of the snap portions 38 is a female snap portion. Female snap portion 38 is formed of a metal. Female snap portion 38 is a hard component. Female snap portion 38 includes an annular outside endless portion that is coaxial with the junction pin 34 of any of the intermediate, upper, and lower junctions 22, 24, and 26.

As shown in FIGS. 7A, 7B, 7C, and 7D, frame 12 further includes an over center lock apparatus 40. Over center lock apparatus 40 includes a pair of arms 42. The arms 42 are identical in structure. Arm 42 includes a proximal end 44 and a distal end 46. Proximal end 42 includes a pin hole 48 for a pivot pin 50. Distal end 46 includes a pin hole 52 for a pivot pin 54. One pivot pin 50 of one arm 42 is pivotally engaged to support member 20 of the inner train 30, pivot pin 50 of the other arm 42 is pivotally engaged to support member 22 of the outer train 28, and pivot pin 54 engages the distal ends 46 of the arms 42 together such that over center lock apparatus 40 is engaged to frame 12 under one of the intermediate junctions 22 such that the support members 18 and 20 that are engaged cross each other and are pivotally joined to each other at a location above where the over center lock apparatus 40 is engaged to the frame 12.

Each of the distal ends 46 includes an outer circular peripheral portion 56 with an inner face 58. The inner faces 58 rotatably slide upon each other when the arms 42 are pivoted relative to each other. Each of the distal ends 46 includes an inner hub 60 with an inner face 62. The inner faces 62 rotatable slide upon each other when the arms 42 are pivoted. Each of the distal ends 46 includes an inner arc segment 64. Inner arc segment 64 runs or extends for about 90 degrees. Inner arc segment 64 includes a first end 66 and a second end 68. The depth or height of the inner arc segment 64 is greater than the depth or height of outer circular peripheral portion 56 and greater than the height or depth of hub 60 such that each of the inner arc segments 64 extends into the other distal end 46. Distal end 46 forms the shape of a receptacle and such receptacle receives the inner arc segment 64 of the opposing distal end 46.

Each of the arms 42 includes an elongate section 70 between the proximal end 44 and the disk shaped or receptacle shaped distal end 46. The elongate section 70 includes a straight edge 72 that defines a straight line. On this straight line is pivot pin hole 52.

The distal end of the elongate section 70 has a height that is equal to the height of the inner arc segment 64 such that the height of the elongate section 70 and inner arc segment 64 is greater than the height of the peripheral portion 56. A slot in the form of an arc is formed between the distal end of the elongate section 70 and the inner arc segment 64 and this slot receives the peripheral portion 56 of the other disk like distal end 46 so as to provide a stable rotation or pivoting between the two arms 42 when faces 58 of the peripheral portions 56 ride upon one another and when faces 62 of the inner hubs 60 ride upon one another. One face of the elongate section 70 is flush with one face of the disk like distal end 46. The other face of the elongate section 70 extends beyond the peripheral circular portion 56. Straight sides or edges 72 of the arms 42 abut each other in a common plane when the second ends 68 abut each other and when the first ends 66 are spaced apart to a maximum degree such that inner arc segment 64 extends for 90 degrees about the inner hub 60.

As shown in FIG. 5D, when the frame 12 is in the collapsed or folded form, straight edges 72 form an inverted V. When the frame 12 is being opened or expanded from the folded form to the operating form, the straight edges 72 move from such inverted V form to an aligned straight form where the straight edges are aligned with each other and then move to a shallow upright V form, which is the locked over center position shown in FIG. 7D. Elongate arm 42 includes ribs extending inwardly from each of the faces of the arms 42.

Where the arms 42 are in the aligned straight form, the arms 42 are pressing the support members 18, 20 resiliently apart to a second position where the support members 18, 20 have a bias to return to a first position. This bias works to push the over center lock apparatus 40 from the shallow upright V state of FIG. 7D to a deeper upright V state, but the ends 66 abut each other such that the over center lock apparatus 40 remains in the shallow upright V state of FIG. 7D. In other words, in such state where the arms 42 are in the locked over center position and where the ends 66 abut each other under pressure, the ends 66 prevent the support members 18, 20 from pivoting toward each other in the direction where upper junctions 24 are drawn together and where lower junctions 26 are drawn together and thus prevent the frame 12 as a whole from being folded to the state where upper junctions 24 are adjacent to each other and where lower junctions 26 are adjacent to each other. To unlock the over center lock 40, the distal ends 46 are pushed upwardly such that the arms 42 move to and through the aligned straight position and to the inverted V position, thereby permitting the upper and lower junctions 24, 26 to be drawn vertically apart from each other so as to increase the height of the frame 12, and thereby permitting the frame 12 to fold to the compact position shown in FIG. 5D. Since sheeting 14 is nonstretchable, sheeting 14 cannot be stretched in the horizontal direction and thus when sheeting 14 is connected to the lower junctions 26 such sheeting 14, namely the floor sheeting portion 76, prevents the support member pairs from spreading or folding to where opposing upper and lower junctions 24, 26 are drawn vertically toward each other. Since sheeting 14 is nonstretchable, sheeting 14 cannot be stretched in the horizontal direction and thus when sheeting 14 is connected to the upper junctions 24 such sheeting 14, namely the intermediate sheeting portion 76, prevents the support member pairs from spreading or folding to where opposing upper and lower junctions 24, 26 are drawn vertically toward each other. Since sheeting 14 is nonstretchable, sheeting 14 cannot be stretched in the vertical direction and thus when sheeting 14 is connected between the lower and upper junctions 26, 24 such sheeting 14, namely inner wall sheeting 86 and a portion of intermediate sheeting 78, prevents the support member pairs from folding to a state where upper junctions 24 are adjacent to each other, where lower junctions 24 are adjacent to each other, and where such folding if permitted to occur increases the height of the frame 12. Accordingly, the over center lock apparatus 40 supplements the vertical sheeting lock that occurs when the sheeting 14 is engaged between the lower junctions 26 and the upper junctions 24. Further, the over center lock apparatus 40 supplements the horizontal sheeting lock that occurs when the sheeting 14 is engaged between the lower junctions 26 simply because the over center lock apparatus 40 is formed of nonstretchable material, thereby preventing a spreading of a support member pair. Still further, the over center lock apparatus 40 supplements the horizontal sheeting lock that occurs when the sheeting 14 is engaged between the upper junctions 24 simply because the over center lock apparatus 40 is formed of nonstretchable material, thereby preventing a spreading of a support member pair. First and second over center lock apparatus 40 may be provided, where the first and second over center lock apparatus 40 diametrically oppose each other on the frame 12.

Off the frame 12, sheeting 14 takes the form of a sock or old military duffel bag or tube, where the sock, duffel bag, or tube includes an open end, an intermediate portion, and a closed end. If a sock and if the sock is on the lower portion of a leg and drawn up as far as possible, the open end of the sock is closer to the knee than the intermediate portion.

On the frame 12, the sheeting 14 resembles a sock with an overlapping portion. In other words, on the frame 12, sheeting 14 takes the form of a sock that has had its open end pulled down from a higher position to an overlapping position such that an intermediate portion of the sock is closer to the knee than the open end of the sock that had been pulled up toward the knee.

Figure 2:
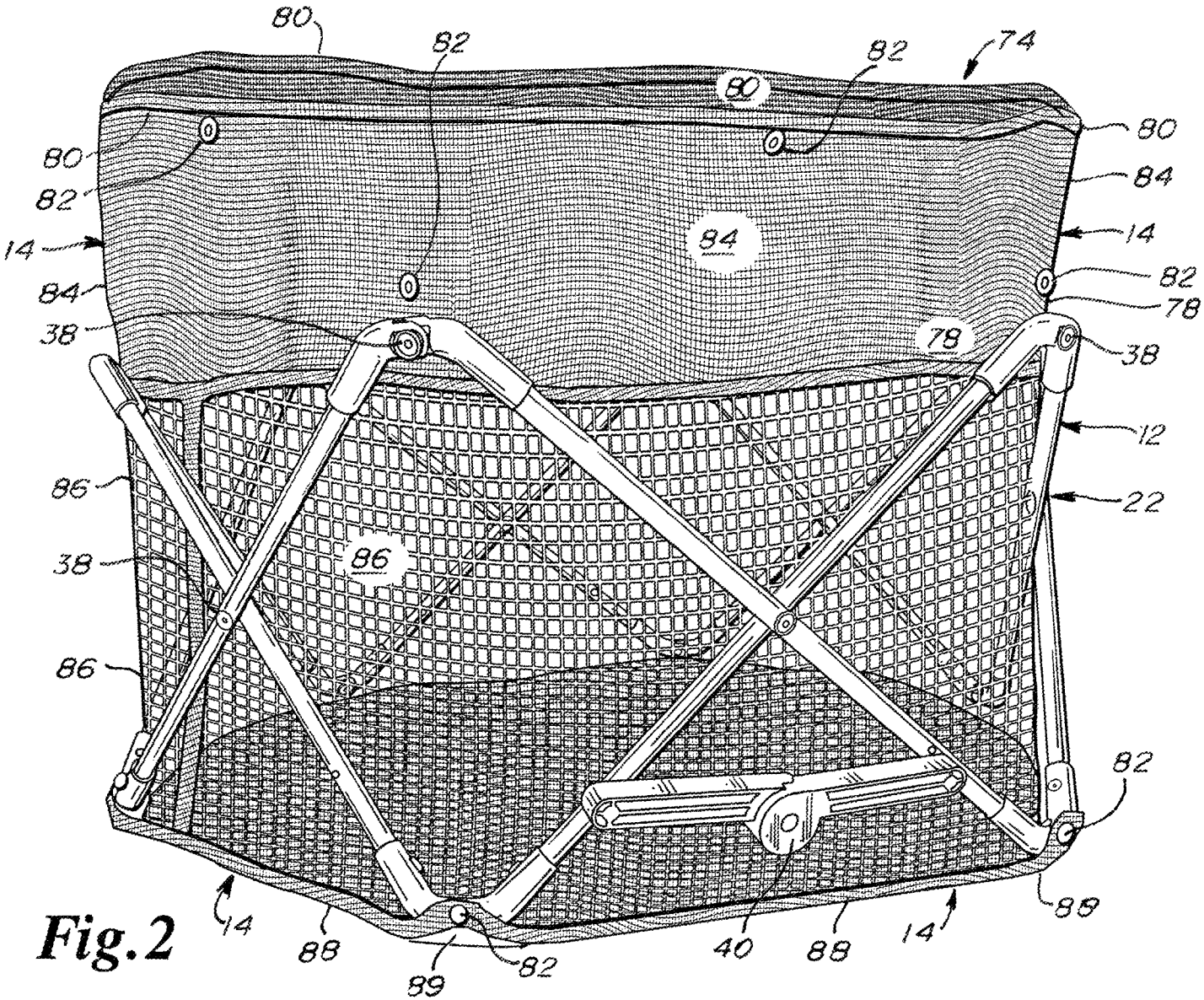
FIG. 2 is a side perspective view of the flexible wall and floor combination or soft components of the present bassinet and frame or hard components of the present bassinet of FIG. 1, where the flexible wall and floor combination or soft components are in the process of being engaged with the frame or hard components.
Figure 3:
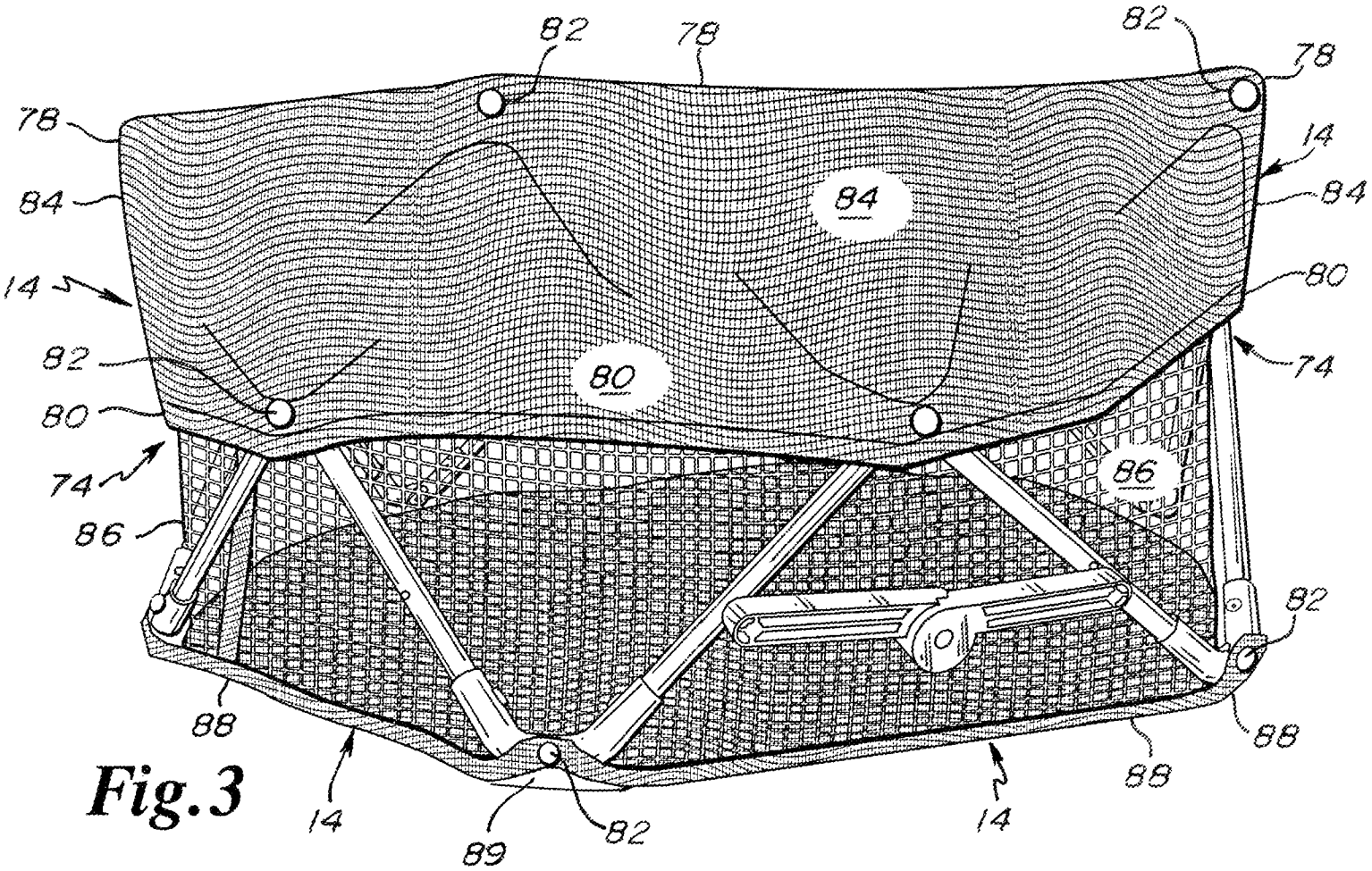
FIG. 3 is a side perspective view of the present bassinet in an open and operating position, where the flexible wall and floor combination or soft components have been turned down relative to FIG. 2 and where the flexible wall and floor combination or soft components are engaged with the frame or hard components.

FIG. 2 shows the "pulled up to be adjacent to the knee" position of the sheeting 14. FIG. 3 shows the position where the open end of the sheeting 14 has been pulled down.

Sheeting 14 includes an open end 74 that is engaged to the snap portions 38 of the intermediate junctions 22. From the intermediate junctions 22 the sheeting 14 extends upwardly on an outside portion of the frame 12 to an upper portion of the frame 12 defined by the upper junctions 24, where an intermediate portion 78 of the sheeting 14 is engaged to the snap portions 38 of the upper junctions 24. From the upper portion of the frame 12, the sheeting 14 extends over the top of the frame 12 and then extends downwardly on an inside portion of the frame 12 to the floor 76 or closed end 76 of the sheeting 14, where portions of the floor 76 then extend to an outside of the frame 12 such that portions of the floor 76 are engaged to the snap portions 38 on the outside of the lower junctions 26.

The open end 74 of sheeting 14 includes a first or open end or distal end endless edge portion 80 that surrounds the frame 12. The open end endless edge portion 80 includes male snap portions 82 that engage the female snap portions 38 of the intermediate junctions 22.

From the open end endless edge portion 80, the sheeting 14 includes an outer endless wall portion 84 that extends upwardly toward a top of the frame 12 defined by the upper junctions 24. Outer endless wall portion 84 hides from view the upper half portions of the support members 18, 20.

At the top of the outer endless wall portion 84, the sheeting 14 transitions into the intermediate sheeting portion 78 or upper endless edge portion 78 that envelopes the top of the frame 12 defined by the upper junctions 24. The upper endless edge portion 78 includes male snap portions 82 that engage the female snap portions 38 of the upper junctions 24.

From the upper end endless edge portion 78 that forms an inverted U-shape over the top of the frame 12, sheeting 14 extends downwardly along an inside of the frame 12. This portion of the sheeting 14 is an inner endless wall portion 86 that extends from the upper end endless edge portion 78 to the floor 76 or closed end 76 of the sheeting 14. Inner endless wall portion 86 engages floor 76 at folded over sheeting portion or double sheeting portion 88 of the floor 76. Double sheeting portion 88 captures the lower edge of the inner wall 86. Double sheeting portion 88 defines a periphery of the floor 76. Floor 76 includes triangular flexible nonslip portions 89. Sheeting 14 includes the triangular flexible portions 89 at locations adjacent to the lower junctions 26. Triangular flexible portions 89 are formed of a rubber or rubber like or elastomer material or flexible plastic material to provide a nonslip portion when the bassinet 10 is set up on hardwood floors, tile floors, smooth floors, flat floors, chairs, table tops, or other furniture with smooth or flat top surfaces. The undersides of the triangular flexible portions 89 are roughened. Triangular flexible portions 89 are engaged, such as by gluing or stitching, to the underside of floor 76 at locations adjacent to the lower junctions 26, which lower junctions 26 bring weight to bear on the upper faces or sides of the triangular flexible portions 89. The double sheeting portion 88 may be engaged over a portion of the underside of the triangular flexible portion 89 such that the male snap portions 82 may engage both of the triangular flexible portion 89 and the double sheeting portion 88. The elastomeric or plastic flexible portion 89 also serves to provide a tougher base for the male snap portion 82, to make it less likely that the male snap portion 82 rips out of the sheeting 14. If desired, all male snap portions 82 for each of the intermediate, upper, and lower junctions 22, 24, 26 may have a base of an elastomeric or plastic flexible material, measuring about one inch by one inch to about two inches by two inches, that is glued or stitched to sheeting 14 about the male snap portion 82 such that the male snap portion 82 is anchored to such elastomeric or plastic flexible base as well as being engaged to sheeting 14. Male snap portions 82 engage the female snap portions 38 of the lower junctions 26. Inner endless wall portion 86 may be a mesh.

Figure 4:
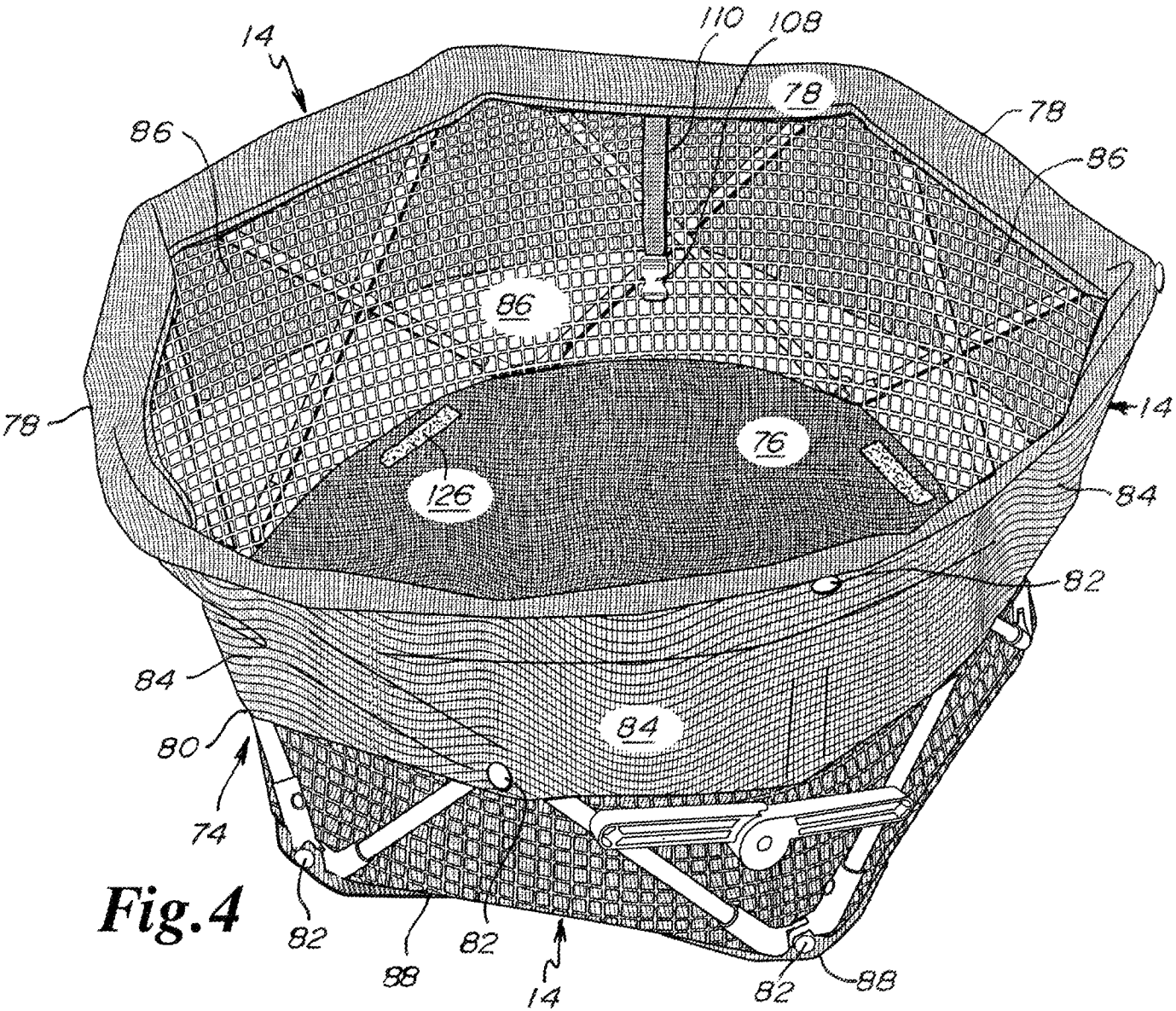
FIG. 4 is a top perspective view of the present bassinet of FIG. 3, where the present bassinet is in an open and operating position.

Canopy 16 includes an endless wire stiffener 90 or flexible elongate stiffener 90 in a perimeter sleeve 92. The stiffener 90 is resiliently bendable. The stiffener 90 seeks to return to the flat form shown in FIG. 6C after being folded or bent. The stiffener 90 does not remain in its folded or bent form but returns to the flat form of FIG. 6C once released from the folded or bent form, one form of which is shown in FIG. 5C. Within the perimeter sleeve 92 and engaged thereto is the main flexible fabric body 94 or sheeting 94. Canopy 16 is formed in an oblong shape. Oblong means "deviating from a square, circular, or spherical form by elongation in one dimension." Canopy 16 includes a fabric strip or sleeve 96 that is stitched to the canopy 16 in a straight manner from one end 98 of the canopy 16 to the other end 100 of the canopy 16. At each of the ends 98, 100, canopy 16 includes a respective flexible fabric strap 102 having a respective proximal end 104 and a respective distal end. One distal end includes a male connector or quick connect 106. The other distal end includes an identical male connector or quick connect 107 such that canopy 16 includes a first and second male connectors 106, 107. The proximal end 104 is engaged to the body 94, strip 96 and a portion of sleeve 92. The remainder of the strap 102 is free such that the strap 102 may be manipulated and flexed and perhaps twisted such that first male connector 106 may engage a first female connector 108, shown in FIG. 4, engaged to the inner wall 86 of the sheeting 14. Strip 96 is a sleeve that houses another elongate stiffener 90 having ends that are free of the stiffener 90 in sleeve 92. The elongate stiffener 90 in the sleeve 96 extends the length of the sleeve 96 such that the ends of the elongate stiffener 90 in the sleeve 96 terminate at about the junction of strap 102 with sleeve 92. Elongate stiffener 90 in sleeve 96 has a bias or nontensioned form in the straight state. After being curved or under tension as shown in FIG. 5A, the elongate stiffener 90 in sleeve 96 resiliently returns to the flat form shown in FIG. 6C.

First female connector 108 is engaged to the inner wall 86 intermediate of the sheeting floor 76 and the sheeting portion 78 that is engaged over the top of the frame 12. First female connector 108 is engaged to a lower end of a first fabric strip 110. An upper end of the first fabric strip 110 is engaged to sheeting portion 78. Upper and lower ends of the first fabric strip 110 are engaged to inner wall 86. First fabric strip 110 includes a body between the upper and lower ends and the body of the first fabric strip 110 is also engaged to inner wall 86, such as by stitching. First fabric strip 110 is straight and extends in a vertical manner downwardly from the sheeting portion 78 that is engaged over the top of the frame 12. There is a second fabric strip 110, identical in structure and engaged in an identical manner to sheeting 14, that is disposed diametrically opposite the first fabric strip 110. Second fabric strip 110 has engaged thereto a second female connector 112, shown in FIG. 5A, for engaging the second male connector 107. The inner diameter of bassinet 10, or frame 12, and length of the canopy 16 are selected such that the canopy 16 takes a flexed state when the male connectors 106, 107 are engaged to their respective female connectors 108, 112. In the flexed and engaged state the canopy 16 may be moved or pivoted such that the canopy 16 may be moved in relation to where the sun is so as to provide shade for a child in the bassinet 10. In such pivoting of the canopy 16, the perimeter sleeve 92 makes frictional contact with inner wall 86 and intermediate sheeting section 78 such that the canopy 16 remains at the location chosen by the caretaker. The rounded perimeter ends of the perimeter sleeve 92 make frictional contact with the round interior wall 86 and the inside of the round intermediate sheeting edge portion 78.

Canopy 16 includes connections 113, such as fabric or metal loops. The connections 113 may be employed for engaging mobiles 115. The mobiles 115 shown in FIG. 6C are three-dimensional mobiles 115 in the shape of a heart, half-moon, and flower. The mobiles 115 have their own respective loops, which loops are openable loops having a first end with a macroscopic loop strip and a second end with a macroscopic hook strip. Connection of the strip ends forms a loop, which loop may run through loop connection 113 for a chained engagement.

The first or upper face and the second or lower face of the main sheeting 94 face in opposite directions in the flat nontensioned form or in the tensioned form shown in FIG. 5A. In such flat nontensioned form, the upper face includes north and south end face portions and the lower face includes north and south face portions. When the canopy 16 is twisted to the form shown in FIG. 5C, the north end portion of the upper face confronts the south end portion of the lower face.

The flexible straps 102 of the canopy 16 permit the canopy 16 to be moved vertically and horizontally relative to the frame 12. The flexible straps 102 of the canopy 16 permit the canopy 16 to be moved along the x, y, and z axis relative to the frame 12. The flexible straps 102 of the canopy 16 permit the canopy 16 to be pivoted relative to the frame 12. The flexible straps 102 of the canopy 16 permits the canopy 16 to slide relative to the frame 12.

Figure 5B:
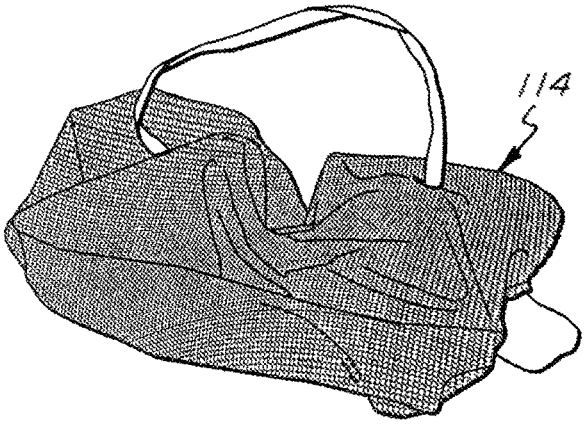
FIG. 5B is a perspective view of a drawstring bag into which both of the frame or hard components, flexible wall and floor combination or soft components, and canopy may be stored.
Figure 5C:
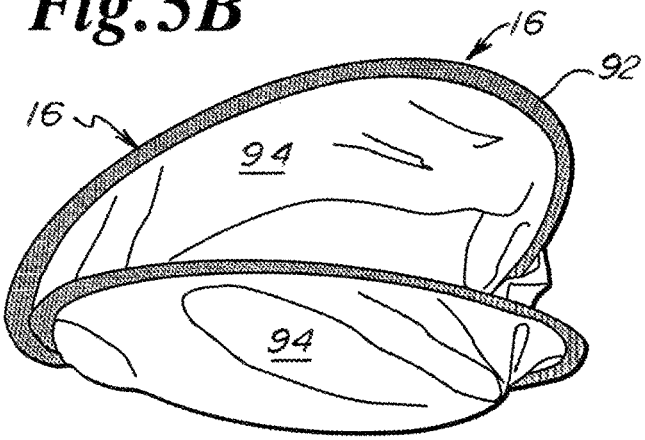
FIG. 5C is a perspective view of the canopy of FIGS. 5A and 6C in the process of being folded.
Figure 5D:
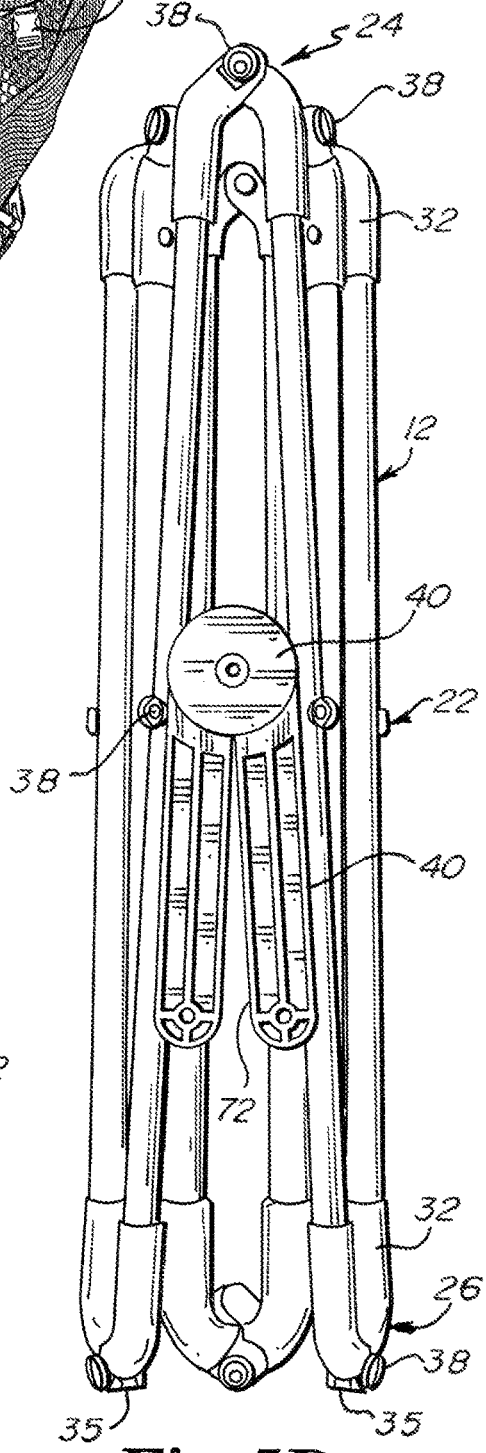
FIG. 5D is a side perspective view of the frame or hard components of FIG. 1 in a folded state.
Figure 6A:
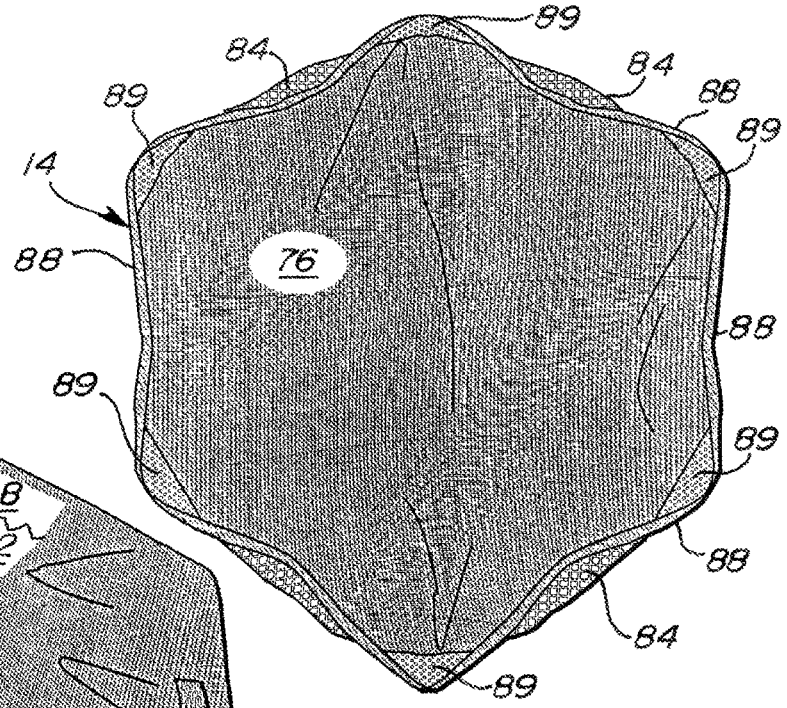
FIG. 6A is a bottom view of the bassinet of FIG. 4.
Figure 6B:
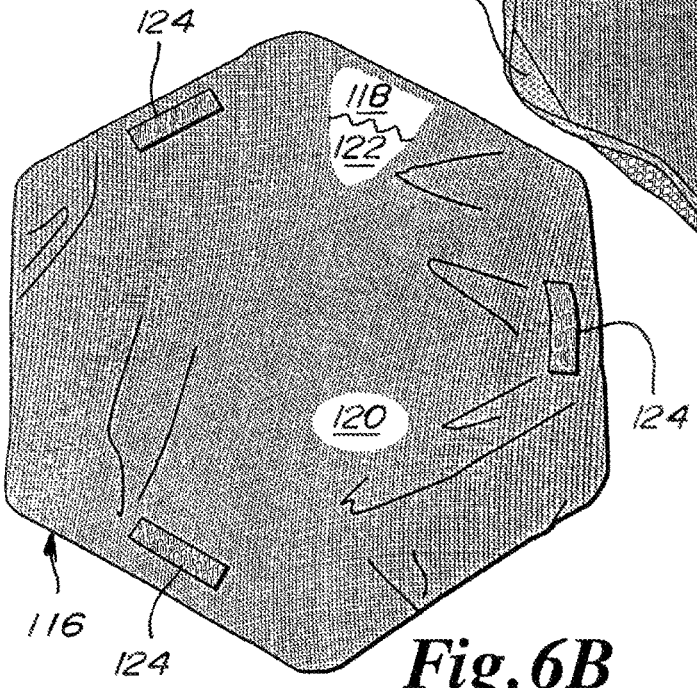
FIG. 6B is a bottom view of a cushioned mat that may be placed in the bassinet of FIG. 4 and upon the floor of the bassinet of FIG. 4.
Figure 6C:
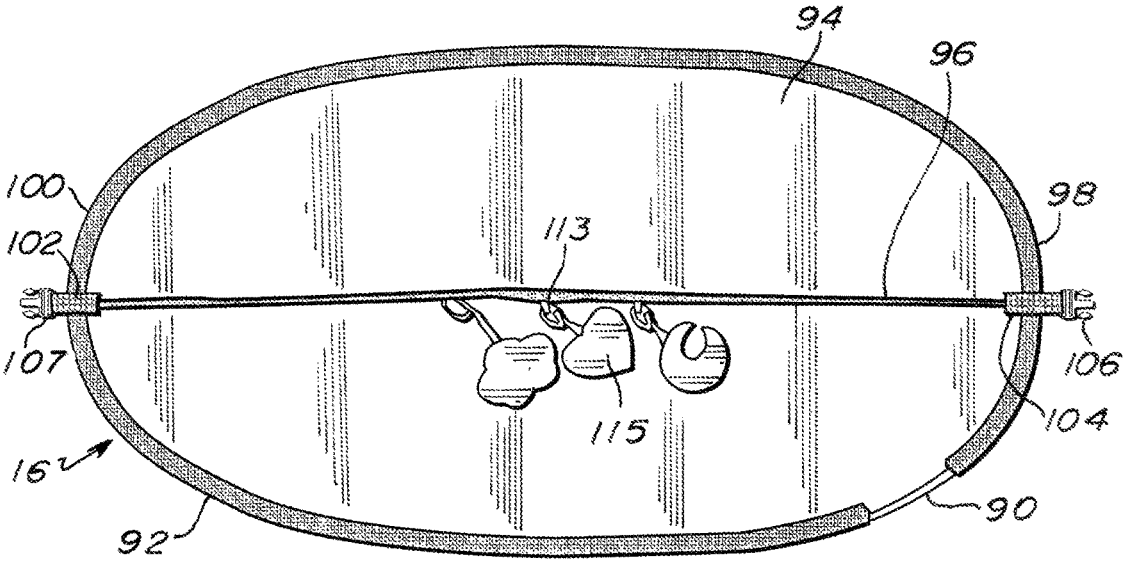
FIG. 6C is a top view of the canopy of FIG. 5A in a nonflexed, unengaged state.
Figure 7A:
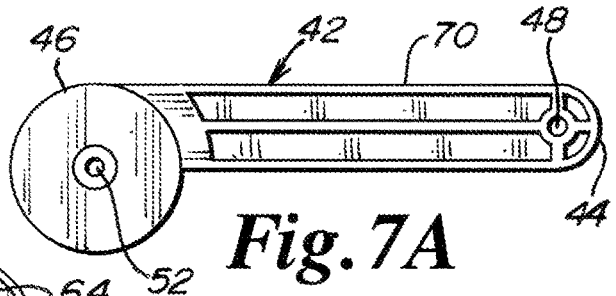
FIG. 7A is an isolated side view of one of the arms of an over center lock apparatus, where the over center lock apparatus is shown in FIGS. 1, 2, 3, 4, 5D, 7C, and 7D.
Figure 7B:
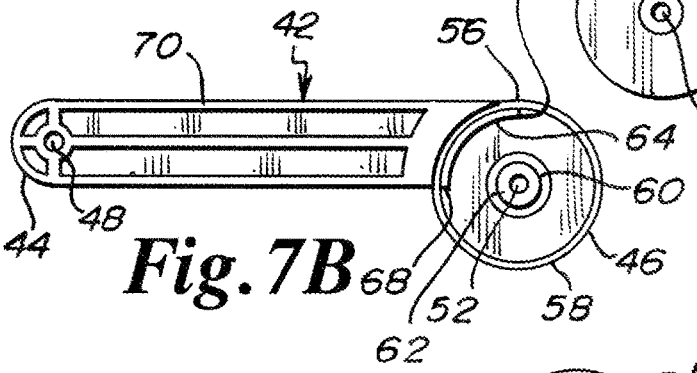
FIG. 7B is an isolated side view of the other of the arms of the over center lock apparatus that is shown in FIGS. 1, 2, 3, 4, 5D, 7C, and 7D.
Figure 7C:
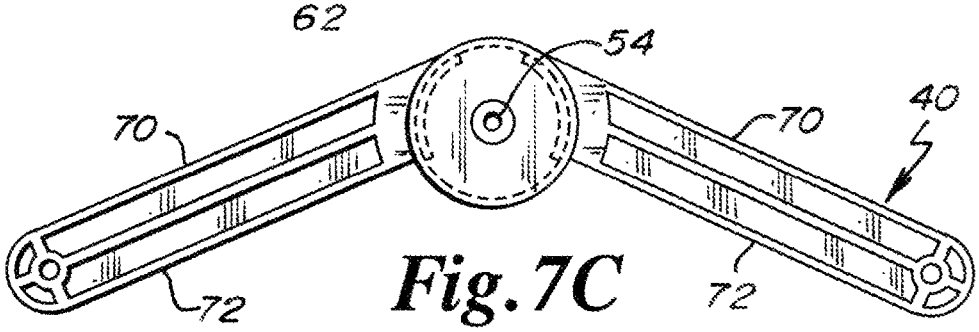
FIG. 7C is a side view of the over center lock apparatus having the arms of FIGS. 7A and 7B engaged in an unlocked position.
Figure 7D:
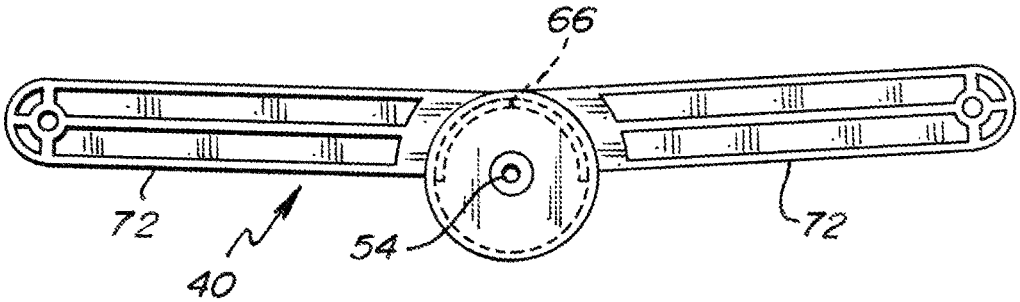
FIG. 7D is a side view of the over center lock apparatus having the arms of FIGS. 7A and 7B engaged in an over center locked position.

As shown in FIG. 5C, the stiffener 90 permits the canopy 16 to be folded or twisted into a figure eight form at least once such that the canopy 16 can be stored in a drawstring flexible carrying bag 114 shown in FIG. 5B, where the carrying bag 114 includes sufficient space therein for the folded frame 12 shown in FIG. 5D, the sheeting 14, and a cushioned floor pad 116 shown in FIG. 6B.

Cushioned floor pad 116 includes a front sheet 118, a rear sheet 120, and a cushion 122 disposed therebetween. Cushioned floor pad 116 includes a hexagonal shape that is tailored both in shape and in width to fit with little movement on floor 76 within inner wall 86, where inner wall 86 takes generally the form of a hexagon in section. To also aid in minimizing movement of cushioned floor pad 116, cushioned floor pad 116 includes strips 124 of a fabric quick connect having macroscopic hooks and macroscopic loops, such as Velcro®, that engage associated strips 126 of macroscopic hooks and macroscopic loops, such as Velcro®, engaged to the upper side of the floor 76 of sheeting 14.

In operation, to store the bassinet 10, the canopy 16 is removed by disengaging the male quick connects 106, 107 from their respective female quick connects 108, 112. Then the over center lock apparatus 40 is unlocked by pushing the underside of the over center lock apparatus 40 upwardly. The preferred portion of the underside to push upon is at or near the underside of the disk like distal ends 46 such that the over center lock apparatus 40 moves from a shallow upright V-shape state, through an aligned state where the axis of arms 42 form a single straight line, and to an inverted V-shape state. As the arms 42 form the single straight line, the arms 42 resiliently spread apart the support members 18, 20 to which they are connected. As the arms 42 move out of such straight line relationship, such resilient energy of the support members 18, 20 pushes the arms 42 into the inverted V-shape state. However, since this action begins to draw the upper junctions 24 together together and begins to draw the lower junctions 26 together, this action also increases the height of the pairs of support members 18, 20. After a minimal increase in height of the pairs of support members 18, 20, a continued increase in height is prevented by sheeting 14. Namely, since the sheeting 14 is connected both at the lower junctions 26 and upper junctions 24, and since the sheeting 14 is not expandable or stretchable, the support members 18, 20 cannot fold beyond a minimum amount after the over center lock apparatus 40 is unlocked. Thus, before the over center lock apparatus 40 is unlocked, or right after the over center lock apparatus 40 shifts to an unlocked position slightly beyond the state where the arms 42 form a straight line with each other, the male snap portions 82 are snapped out of the female snap portions 38, at all of the intermediate junctions 22 and at all of the upper junctions 24. The male snap portions 82 may remain engaged to the female snap portions 38 at the lower junctions 26. Then the frame 12 may be fully collapsed to the position shown in FIG. 5D with the sheeting 14 engaged to the frame 12 at the lower junctions 26 and with the over center lock apparatus 40 being drawn up to the fully inverted V-shape position, whereupon in such state the collapsed frame 12 and sheeting 14 may be placed in the carrying bag 114 shown in FIG. 5B.

In operation, the frame 12 may be taken out of the carrying bag 114 with or without the sheeting 14 engaged thereon. If the sheeting 14 is engaged thereon where the sheeting 14 is engaged to the frame 12 at the lower junctions 26, the first step is to expand or fold out the frame 12. Then the intermediate sheeting portion 78 is folded over the top of the frame 12 and engaged to the frame 12 at the upper junctions 24. Then the end endless edge sheeting portion 80 is engaged to the frame 12 at the intermediate junctions 22. Then the over center lock apparatus 40 can be pushed from the inverted V-shape, through the state where the axis of the arms 42 are aligned in a common straight line, and to the over center position where the axis of the arms 42 form the shallow upright V-shape. Then the cushioned pad 116 may be placed upon the floor 76 of the sheeting 14 with or without the fabric strips 124, 126 engaging each other. Then the canopy 16 may be engaged to the bassinet 10 by the quick connects 106, 107, 110, 112.

In operation, after the bassinet 10 is open and in its operating and locked state, paired support members 18, 20 may not fold either way. In other words, the ends of paired support members 18, 20 may not be drawn apart from each other because sheeting 14, which is not expandable and not stretchable, is A) engaged at the upper junctions 24 and B) engaged at the lower junctions 26 with each of "A" and "B" acting as a sheeting lock independently of the other. In other words, floor sheeting 76 is not stretchable in width and the intermediate sheeting portion 78 is not stretchable in width. Also, the ends of paired support members 18, 20 may not be drawn toward each other because sheeting 14, which is not expandable and not stretchable, is connected between the lower junctions 26 and the upper junctions 24 so as to prevent an increase in height of paired support members, which increase in height occurs when the ends of paired support members 18, 20 are permitted to be drawn toward each other. The over center lock apparatus 40 supplements the sheeting lock or sheeting connection between the lower junctions 26 and the upper junctions 24 by the ends 66 of the arc segments 64 abutting each other when an attempt is made to push the ends of the paired support members 18, 20 toward each other. The connections of the sheeting 14 at the intermediate junctions 22 reinforce the sheeting connections at the upper junctions 24 to hold the intermediate sheeting portion 78 down on top of the frame 12 such that the sheeting 14 resists any folding of the paired support members 18, 20 and the attendant or accompanying increase in height of such paired support members 18, 20.

When in the open, operating and folded out position shown in FIG. 1 with or without sheeting 14 engaged thereto, and when in the closed and folded in position shown in FIG. 5D with or without sheeting 14 engaged thereto, the intermediate junctions 22 define an intermediate plane, the upper junctions 24 define an upper plane, and the lower junctions 26 define a lower plane. Such intermediate plane is spaced from each of such upper and lower planes. Each of the upper junctions 24 defines a vertical line with one of the lower junctions 26. Each of the intermediate junctions 22 are staggered relative to such vertical line such that each of the intermediate junctions 22 is disposed between two such adjacent vertical lines. Each of the intermediate, upper and lower junctions 22, 24, 26 has a sheeting connection 38 disposed on the outside of such respective junction so as to be disposed on the outside of the frame 12.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bassinet comprising:

a) a frame, the frame having upper junctions, intermediate junctions, and lower junctions, the frame having an outside, an inside, a top, and a bottom;

b) a flexible sheet having a first sheet end, a second sheet end, and an intermediate sheet portion between the first and second sheet ends, the first sheet end being open, the second sheet end being closed and being a floor, the flexible sheet extending inside of the frame from the bottom of the frame to the top of the frame, the flexible sheet extending over the top of the frame, the flexible sheet extending outside of the frame from the top of the frame to the intermediate junctions or to locations adjacent to the intermediate junctions;

c) the first sheet end having a first edge portion, the second sheet end having a second edge portion;

d) the first edge portion of the first sheet end being engaged to the frame at the intermediate junctions or at frame locations adjacent to the intermediate junctions;

e) the second edge portion of the second sheet end being engaged to the frame at the lower junctions or at frame locations adjacent to the lower junctions; and f) wherein the intermediate sheet portion includes a third edge portion, and wherein the third edge portion is engaged to the frame at the upper junctions or at frame locations adjacent to the upper junctions.

2. The bassinet of claim 1, wherein the first edge portion of the first sheet end is engaged to the outside of the frame.

3. The bassinet of claim 1, wherein the second edge portion of the second sheet end is engaged to the outside of the frame.

4. The bassinet of claim 1, wherein the third edge portion of the intermediate sheet portion is engaged to the outside of the frame.

5. The bassinet of claim 1, wherein the sheeting is one-piece.

6. A bassinet comprising:

a) a frame, the frame having an outside, an inside, a top, and a bottom;

b) sheeting, the sheeting having an outer sheet wall, an inner sheet wall, and a closed end, the outer sheet wall being disposed outside of the frame, the inner sheet wall being disposed inside of the frame, the outer and inner sheet walls being integrally joined adjacent to a top of the frame;

c) the outer sheet wall having a distal end edge portion spaced from the top of the frame and spaced from the bottom of the frame, the distal end edge portion engaged to the frame;

d) the sheeting having an upper edge portion adjacent to the top of the frame, the upper edge portion engaged to the frame;

e) the inner sheet wall being engaged to the closed end, the closed end having a bottom edge portion adjacent to the bottom of the frame, the bottom edge portion engaged to the bottom of the frame;

f) the distal end edge portion of the sheeting being engaged to the frame at a plurality of intermediate frame locations, the intermediate frame locations defining an intermediate plane;

g) the upper edge portion of the sheeting being engaged to the frame at a plurality of upper frame locations, the upper frame locations defining an upper plane;

h) the bottom edge portion of the sheeting being engaged to the frame at a plurality of lower frame locations, the lower frame locations defining a bottom plane;

i) each of the upper frame locations defining a vertical line with one of the lower frame locations; and j) each of the intermediate frame locations being staggered relative to the upper and lower frame locations such that each of the intermediate frame locations is disposed between two adjacent vertical lines.

7. The bassinet of claim 6, wherein the upper plane is spaced from the intermediate plane which in turn is spaced from the bottom plane.

8. The bassinet of claim 6, wherein each of the intermediate frame locations is on the outside of the frame.

9. The bassinet of claim 6, wherein each of the upper frame locations is on the outside of the frame.

10. The bassinet of claim 6, wherein each of the lower frame locations is on the outside of the frame.

11. The bassinet of claim 6, wherein each of the upper and lower frame locations is on the outside of the frame.

12. The bassinet of claim 6, wherein each of the upper, intermediate, and lower frame locations is on the outside of the frame.

13. A bassinet comprising:

a) a frame, the frame having upper junctions, intermediate junctions, and lower junctions, the frame having an outside portion, inside portion, a top portion, and a bottom portion;

b) each of the intermediate junctions having an intermediate quick connect, the intermediate quick connect being disposed on an outer portion of said intermediate junction;

c) each of the lower junctions having a lower quick connect, the lower quick connect being disposed on an outer portion of said lower junction;

d) a flexible sheet having a first sheet end and a second sheet end, the first sheet end being open, the second sheet end being closed and being a floor, the first sheet end having a first edge portion, the second sheet end having a second edge portion;

e) the first edge portion having quick connects that engage to each of the intermediate quick connects;

f) the flexible sheet having an outer sheet wall portion that extends from the intermediate junctions to the top portion of the frame, the outer sheet wall portion being outside the frame;

g) the flexible sheet having an inner sheet wall portion that extends from the top portion of the frame to the bottom portion of the frame where the inner sheet wall portion engages the second end of the sheeting, the inner sheet wall portion being inside the frame; and h) the second edge portion of the second end of the sheeting having quick connects that engage each of the lower quick connects;

i) such that the sheeting extends from the intermediate junctions to the top of the frame along the outside of the frame, from a top outside of the frame to a top inside of the frame, from the top inside of the frame to the bottom of the frame along an inside of the frame, and from a bottom inside of the frame to a bottom outside of the frame where the sheeting engages the lower quick connects.

14. The bassinet of claim 13, wherein each of the upper junctions includes an upper quick connect, the upper quick connect being disposed on an outer portion of said upper junction, and wherein the sheeting includes quick connects that engage each of the upper quick connects.

15. The bassinet of claim 13, wherein each of the lower junctions includes a bottommost face, wherein the second endless edge portion of the second end of the sheeting extends from inside of the frame to outside of the frame at the lower junction, and wherein the bottommost face of said lower junction is disposed on top of the second endless edge portion of the second end of the sheeting.

16. A bassinet comprising:

a) a frame, the frame having upper junctions, intermediate junctions, and lower junctions;

b) a flexible wall and floor combination inside of the frame, the flexible wall and floor combination having an open end and a closed end; and c) a panel engaged to the flexible wall and floor combination, the panel including sheeting having a perimeter, the perimeter having a flexible elongate stiffener, the flexible elongate stiffener being biased to an open nontensioned form where the panel defines a plane, the panel having a U-shaped form where the flexible elongate stiffener is under tension;

d) the panel having first and second ends, each of the first and second ends being engagable to one of the frame and flexible wall and floor combination such that, when each of the first and second ends are engaged to one of the frame and flexible wall and floor combination, the panel has the U-shaped form;

e) wherein the first end of the panel is removably engaged to the flexible wall and floor combination at a first location on an inside of the flexible wall and floor combination, and wherein the second end of the panel is removably engaged to the flexible wall and floor combination at a second location on the inside of the flexible wall and floor combination, the first and second locations being diametrically opposite of each other; and f) wherein the first location is spaced from each of the open end and closed end of the flexible wall and floor combination, and wherein the second location is spaced from each of the open end and closed end of the flexible wall and floor combination.

17. The bassinet of claim 16, wherein the panel includes a first face and a second face, the first and second faces facing in opposite directions in the open form, the panel being twistable from the open nontensioned form where the panel defines a plane to a twisted form where a portion of the first face confronts a portion of the second face.

18. The bassinet of claim 16, wherein an engagement between the first end and one of the frame and flexible wall and floor combination is a flexible engagement, and wherein an engagement between the second end and one of the frame and flexible wall and floor combination is a flexible engagement such that the panel in the U-shaped form can be moved vertically and horizontally.

* * * * *